US011231049B2

(12) United States Patent
Holt et al.

(10) Patent No.: US 11,231,049 B2
(45) Date of Patent: Jan. 25, 2022

(54) BLOWER AND A BLOWER DIFFUSER

(71) Applicant: NOVENCO BUILDING & INDUSTRY A/S, Næstved (DK)

(72) Inventors: Peter Holt, Næstved (DK); Martin Rasmussen, Næstved (DK)

(73) Assignee: NOVENCO BUILDING & INDUSTRY A/S, Næstved (DK)

( * ) Notice: Subject to any disclaimer, the term of this patent is extended or adjusted under 35 U.S.C. 154(b) by 154 days.

(21) Appl. No.: 16/264,856

(22) Filed: Feb. 1, 2019

(65) Prior Publication Data

US 2019/0242405 A1 Aug. 8, 2019

(30) Foreign Application Priority Data

Feb. 2, 2018 (DK) ..... PA201870066

(51) Int. Cl.
*F04D 29/54* (2006.01)
*F04D 29/52* (2006.01)
*F04D 19/00* (2006.01)

(52) U.S. Cl.
CPC ..... *F04D 29/524* (2013.01); *F04D 29/545* (2013.01); *F04D 19/002* (2013.01)

(58) Field of Classification Search
CPC ..... F04D 29/524; F04D 29/545; F04D 29/54; F04D 29/541; F01D 19/002
See application file for complete search history.

(56) References Cited

U.S. PATENT DOCUMENTS

| | | | | |
|---|---|---|---|---|
| 1,743,731 | A | 1/1930 | Scott | |
| 2,687,687 | A | 8/1954 | Prudhon | |
| 4,094,336 | A | 6/1978 | Urschel et al. | |
| 4,146,048 | A * | 3/1979 | McCabe | A62C 2/14 126/285 R |
| 7,611,403 | B2 * | 11/2009 | Wenger | F24F 7/013 415/147 |
| 2006/0105696 | A1 | 5/2006 | Wenger | |
| 2009/0023378 | A1 | 1/2009 | Hansen et al. | |
| 2011/0183600 | A1 | 7/2011 | Chua | |
| 2013/0051999 | A1 | 2/2013 | Wenger et al. | |
| 2016/0178233 | A1 | 6/2016 | Santucci | |

FOREIGN PATENT DOCUMENTS

EP 1835239 A2 9/2007

* cited by examiner

*Primary Examiner* — Eldon T Brockman
*Assistant Examiner* — Michael L Sehn
(74) *Attorney, Agent, or Firm* — Oliff PLC

(57) ABSTRACT

A diffuser arranged at the downstream side of a blower, the diffuser including a conical diffuser shroud with a back draft damping butterfly valve arranged in the diffuser opening, and where the butterfly valve includes two doors both being attached to the diffuser shroud via a hinge arrangement adapted for allowing each of the two doors to rotate between a closed and an open position about the hinge axes extending between opposite sides of the diffuser shroud and where the doors are shaped so that they together substantially close the diffuser opening when they are in their closed position, and wherein each hinge axis intersects the diffuser shroud at a position closer to the upstream side at one side than on the opposite side of the diffuser shroud.

10 Claims, 3 Drawing Sheets

BLOWER AND A BLOWER DIFFUSER

THE PRIOR ART

The present invention relates to a diffuser adapted for being mounted at the downstream side of a blower and comprising a diffuser shroud being substantially circular symmetrical about an axis of symmetry and having an upstream side provided with means for attaching the diffuser to the exhaust end of a blower pipe and a downstream side opposite the upstream side, and where the diffuser shroud encircles a diffuser opening having a cross section perpendicular to the axis of symmetry that increases from the upstream side of the diffuser to the downstream side of the diffuser, and where a back draft damping butterfly valve is arranged in the diffuser opening, the butterfly valve comprising two doors both being attached to the diffuser shroud via a hinge arrangement adapted for allowing each of the two doors to rotate between a closed and an open position about a hinge axis extending between opposite sides of the diffuser shroud and where the doors are shaped so that they together substantially closes the diffuser opening when they are in their closed position.

An example of such a diffuser is known in various different embodiments such as from e.g. U.S. patent application Ser. No. 2013/0051999, disclosing a fan/blower where the butterfly valve is arranged in the diffuser for the purpose of efficiently reducing back draft into a ventilated space, and where a spring is arranged to ensure that the butterfly valves closes its doors when the fan/blower is not active.

Back draft dampers with butterfly valves are also known, e.g. from U.S. Pat. No. 1,743,731, in various embodiments to be arranged in e.g. ventilation ducts or heat piping, and where the hinge axes for the doors of the butterfly valves are arranged having an angle with respect to the symmetry axis of the ducts or pipes so that the doors are urged by gravity to close when the blower is inactive, and opens when it is activated. The doors of the butterfly valves according to these valve construction are not, however, completely closing the duct themselves, and thereby efficient back draft closure may require gaskets arranged inside the duct for closing the necessary distance between the inside of the duct and the doors of the butterfly valve.

THE OBJECT OF THE INVENTION

On this background it is the purpose of the present invention to disclose a blower of the type mentioned in the introduction, and where the back draft valve arrangement is provided by a simple and inexpensive mechanism that creates very little airflow resistance when the blower is active and at the same time provides efficient back draft resistance when the blower is inactive.

This is achieved by a diffuser as defined by present claim 1 and especially by arranging each hinge axis so that it intersects the diffuser shroud at a position closer to the upstream side at one side than on the opposite side of the diffuser shroud.

Thereby the diffuser may advantageously be attached to, or being integrally produced, with an axial blower having a horizontal blower tube and axis of symmetry, and so that the diffuser to be positioned so that the closest position where each hinge axis intersects with the shroud on the diffuser, are arranged at the uppermost position of the shroud. Thereby, due to the angular position of the hinge axis, the doors of the butterfly valve are gravity operated so that they are urged by the gravity to their closed position when the blower is not activated.

In a preferred embodiment the hinge axis intersects the diffuser shroud at an angle substantially perpendicular to the shroud at the position closest to the upstream side, so that it is possible to design the doors of the butterfly valve with a very small clearance between the doors and the inside of the diffuser shroud.

Each of the two doors may advantageously be formed as semi elliptical door plates so that the two doors in their closed position extends virtually in the same plane and together forms a complete ellipse, and in this relation each of the door plates may furthermore have straight edges that abuts each other in said closed position of the doors, and thereby forms a dividing line between the doors corresponding to the major axis of the ellipse.

In this relation each hinge axis may preferably extend parallel with and on the downstream side of the dividing line between the doors in their closed position.

In an especially advantageous embodiment the hinge arrangement provides two hinge axes, one for each door, and where the two hinge axes are arranged at the same distance downstream from, and on opposite sides of, the dividing line, so that there is a distance between the two doors allowing flow of air between them.

In order to ensure correct positioning of the doors in their closed position, and thereby a tight fit between the doors and the diffuser shroud, then the diffuser shroud may advantageously comprise one or more projections extending from the diffuser shroud and into the diffuser opening, and where the projections are positioned so that the each of the doors, when they are positioned at their closed position, rests against one or more of the projections at their downstream side.

A further reduction of the distance between the doors and the inside of the diffuser shroud may be possible in a further preferred embodiments of the invention where the hinge arrangement comprises a first and a second hinge part mounted on opposite sides of the diffuser shroud, and where the first and second hinge parts extends completely downstream from the dividing line.

In a further advantageous embodiment each door comprises first and second complementary substantially identical hinge parts arranged near opposite ends of the straight edges, and the first complementary hinge parts and the second complementary hinge parts are connected rotatably about the hinge axes to the first and second hinge part respectively.

The hinge arrangement and/or the door plates may also comprise projections adapted for restricting the doors to rotate so that the door plates extend parallel with the axis of symmetry of the diffuser shroud, and so that the door plates, at the open position of the doors diverge from each other downstream from the hinge axes. Thereby the door plates themselves have a diffuser effect on the flow of air between them, and the door closing effect of the gravity is further increased.

A preferred embodiment of the invention comprises an axial blower having a circular symmetrical blower pipe with an axis of symmetry arranged substantially in a horizontal direction, and a blower rotor arranged so that it rotates about the axis of symmetry of the blower pipe, and wherein the axial blower comprises a diffuser according to one or more of the preceding claims, and where the axis of symmetry of the diffuser virtually coincides with the axis of symmetry of the blower pipe.

THE DRAWING

In the following one or more embodiments of the invention will be described in more detail and with reference to the drawing, where:

DESCRIPTION OF EXEMPLARY EMBODIMENTS

Figure 1:
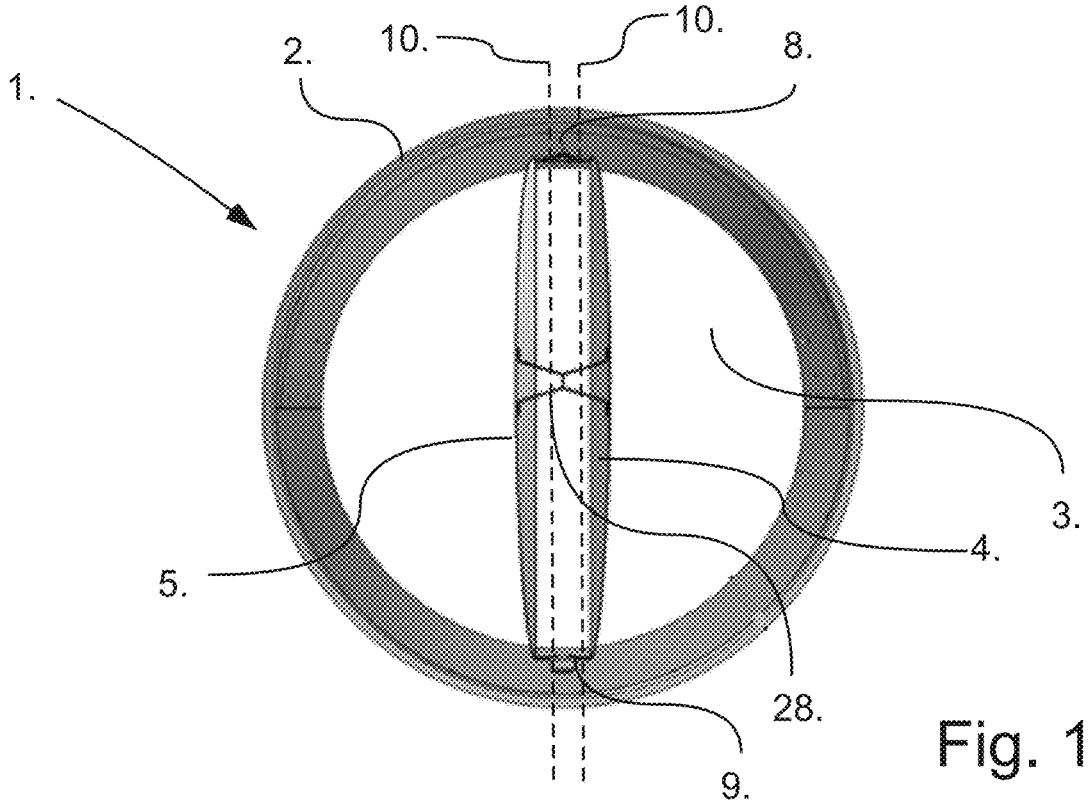
FIG. 1 shows a diffuser according to the invention from the downstream side of the diffuser.
Figure 2:
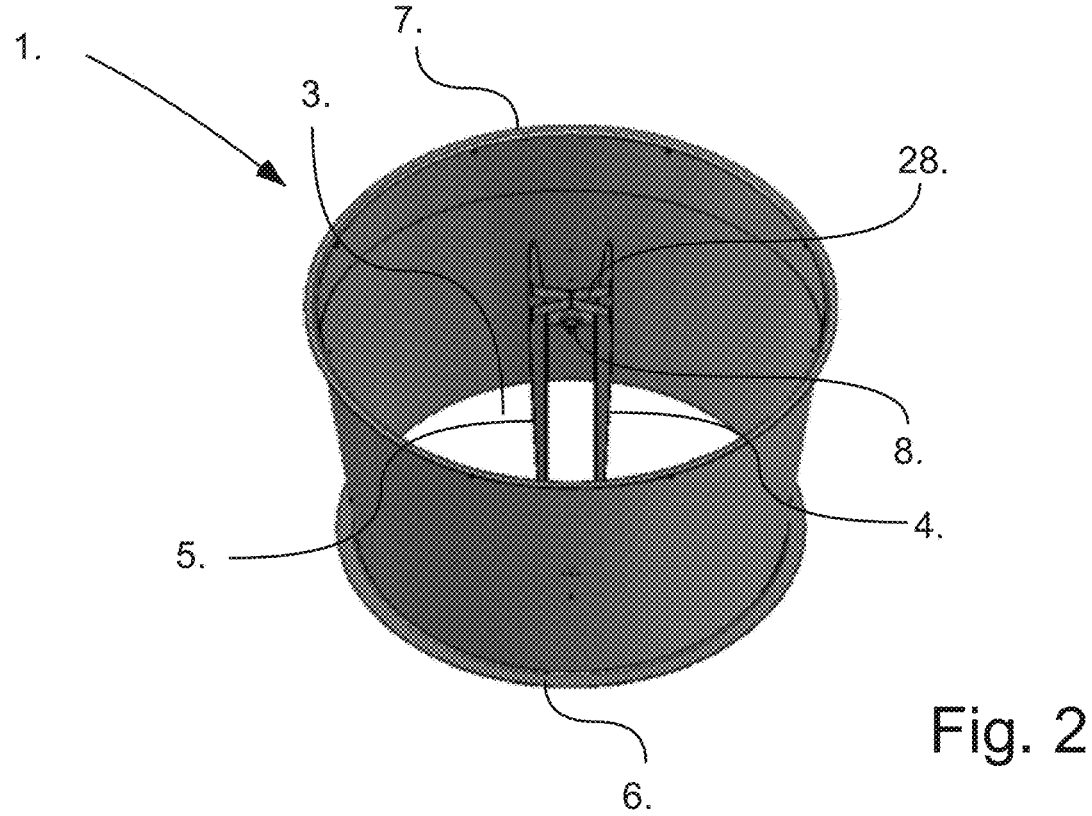
FIG. 2 is a perspective drawing showing the diffuser in FIG. 1 from the downstream side and from below.
Figure 7:
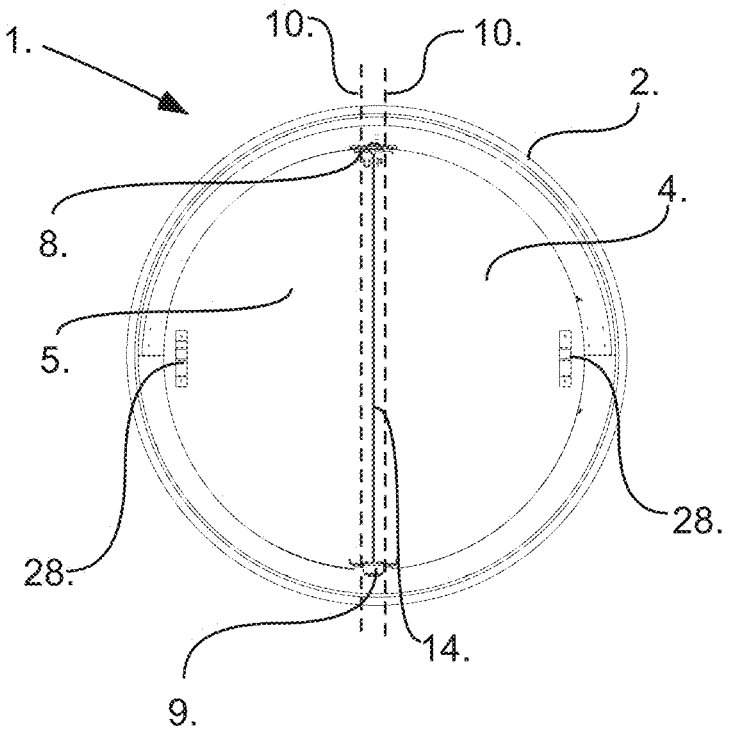
FIG. 7 shows the diffuser as shown in FIG. 1, but with the doors of the butterfly valve in the closed position.

FIGS. 1, 2 and 7 shows one embodiment of a diffuser 1 according to the invention having a circular symmetrical diffuser shroud 2 and having a butterfly valve arranged in the opening 3 of the diffuser 1. The butterfly valve has two doors 4, 5 being arranged in the diffuser shroud between the upstream side 6 and the downstream side 7 of the diffuser shroud 2, and a hinge arrangement with a first hinge part 8 and a second hinge part 9 is provided for allowing the doors to be closed by the force of gravity such as shown in FIG. 7, and to rotate about the hinges axes to their open position as shown in FIGS. 1 and 2.

The butterfly valve thereby forms a one-way valve providing in the closed position of the doors as shown on FIG. 7 an efficient guard against air flowing from the downstream side to the upstream side of the diffuser (back draft).

Figure 3:
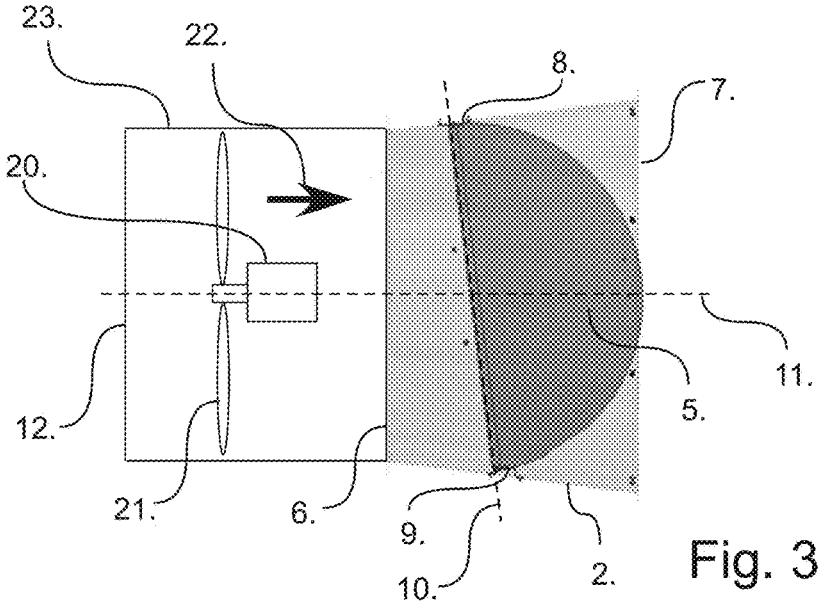
FIG. 3 is principle sketch showing an axial blower with a diffuser as shown in FIGS. 1 and 2.

In FIG. 3 the diffuser according to FIGS. 1 and 2 is shown as a principle sketch where the contours of the diffuser shroud 2 is shown with the doors 4, 5 are attached to the diffuser shroud 2 via the first and the second hinge 8, 9 in the opening 3 of the diffuser shroud 2 so that they can rotate about the hinge axis 10 having an angle with respect to the axis of symmetry 11 that coincides with the axis of symmetry of the axial blower 12 arranged on the upstream side 6 of the diffuser 1, and having a circular cylindrical blower pipe 23 with a blower motor 20 and a blower rotor 21 arranged for forcing air in the direction 22 through the diffuser.

Figure 6:
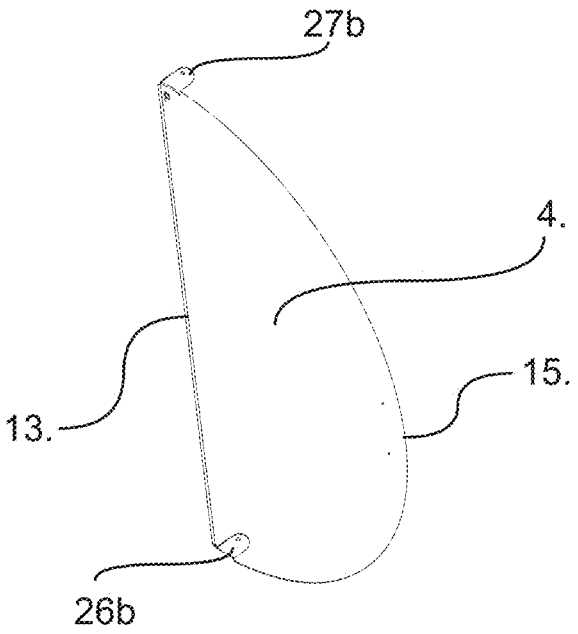
FIG. 6 shows one embodiment of a door of the butterfly valve according to the invention.

Due to the fact that the diffuser shroud 2 has a frustoconical shape, and thereby having a cross section perpendicular to the axis of symmetry 11, then it is possible to design the doors 4, 5 with door plates each having a semi elliptical shape such as shown in FIG. 6, and thereby the periphery of the door plates will form a complete ellipse so that there is only a very small distance between the periphery of the door plates and the inside of the diffuser shroud 2, and the doors 4, 5 also both have straight edges 13 that abut each other to form a dividing line 14 when the doors 4, 5 are in the closed position.

In this relation it will be obvious to the skilled person that it is also possible to designing door plates fitting closely in the opening 3 of a diffuser shroud 2 having another shape than a frustoconical shape as long as the diffuser shroud has a cross section perpendicular to the axis of symmetry that increases from the upstream side of the diffuser 1 to the downstream side.

Figure 4:
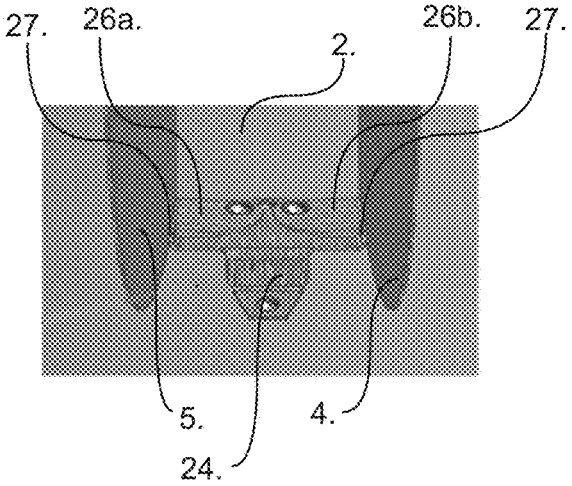
FIG. 4 is a detailed view of one hinge part of the diffuser according to FIGS. 1, 2 and 3.
Figure 5:
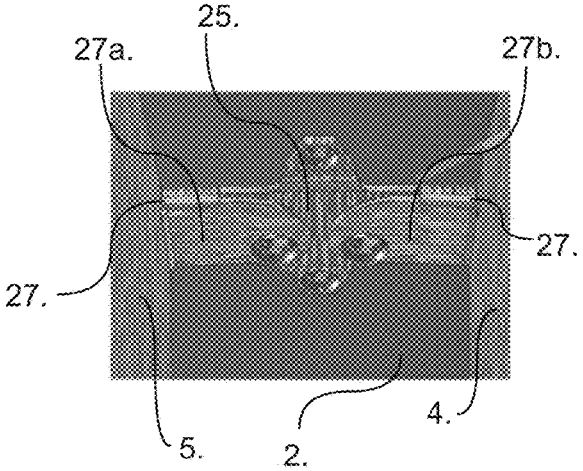
FIG. 5 is a detailed view of another hinge part of the diffuser according to FIGS. 1, 2 and 3

The details of the hinges 8, 9 are shown in FIGS. 4 and 5, where FIG. 4 shows the lowermost hinge 9 and FIG. 5 shows the uppermost hinge 8 as shown on FIG. 3. The lowermost hinge 9 has a first hinge part 24 being attached to the inside of the diffuser shroud 2, and each of two complementary first hinge parts 26*a*, 26*b* formed as hinge flanges attached to the doors 4, 5 are rotatably connected to the first hinge part via rivets allowing the hinge flanges to rotate. Likewise the second hinge parts 27*a*, 27*b* forming part of the uppermost hinge 8 is rotatably connected via rivets to the second hinge part 25.

In order to ensure that the doors 4, 5 are not able to open more than what is shown in the FIGS. 1 through 5 a set of limiting flanges 27 are arranged on the first and second hinge parts engaging with the hinge flanges as shown on FIGS. 4 and 5. Furthermore the doors 4 and 5 are for the same purpose both provided with stoppers 28 also ensuring that the distance between the doors 4, 5 increases with the distance from the hinge axes 10, and thereby providing that also the doors 4, 5 have a diffuser effect on the air flowing between the doors 4, 5.

From the description above it will be apparent to the skilled person that a diffuser according to the invention may be used in connection with, and arranged downstream from, any kind of fan or blower, such as an axial fan, a centrifugal blower or a plug fan, either directly mounted downstream of the fan, or via adaptors. In relation to axial blowers, however, and especially safe function of the diffuser it obtained when the axis of symmetry of the blower coincides with the axis of symmetry of the diffuser.

The invention claimed is:

1. A diffuser adapted for being mounted at the downstream side of a blower, the diffuser comprising a diffuser shroud being substantially circular symmetrical about an axis of symmetry and having an upstream side being attached at the exhaust end of a blower pipe and a downstream side opposite the upstream side, and where the diffuser shroud encircles a diffuser opening having a cross section perpendicular to the axis of symmetry that increases from the upstream side of the diffuser to the downstream side of the diffuser, and where a back draft damping butterfly valve is arranged in the diffuser opening, the butterfly valve comprising two doors both being attached to the diffuser shroud via a hinge arrangement adapted for allowing each of the two doors to rotate between a closed and an open position about a hinge axis extending between opposite sides of the diffuser shroud and where the doors are shaped so that they together substantially close the diffuser opening when they are in their closed position, wherein each hinge axis intersects the diffuser shroud at a position closer to the upstream side at one side than on the opposite side of the diffuser shroud, and wherein two points of intersection between each hinge axis and the diffuser shroud are disposed between the upstream side and the downstream side of the diffuser shroud.

2. The diffuser according to claim 1, wherein each hinge axis intersects the diffuser shroud at an angle substantially perpendicular to the shroud at the position closest to the upstream side.

3. The diffuser according to claim 1, wherein the two doors each are formed as a semi-elliptical door plate so that the two doors in their closed position extend virtually in the same plane and form an ellipse, and where each of the door plates have straight edges that abut each other in said closed position of the doors, and thereby form a dividing line between the doors corresponding to the major axis of the ellipse.

4. The diffuser according to claim 3, wherein each hinge axis extends parallel with and on the downstream side of the dividing line between the doors in their closed position.

5. The diffuser according to claim 4, wherein the hinge arrangement provides two hinge axes, one for each door, and where the two hinge axes are arranged at the same distance downstream from, and on opposite sides of, the dividing line.

6. The diffuser according to claim 3, wherein the hinge arrangement comprises a first and a second hinge part mounted on opposite sides of the diffuser shroud, and where the first and second hinge parts extend completely downstream from the dividing line.

7. The diffuser according to claim 3, wherein each door comprises first and second complementary substantially identical hinge parts arranged near opposite ends of the straight edges, and where the first complementary hinge parts and the second complementary hinge parts are connected rotatably about the hinge axes to other first and second hinge parts, respectively.

8. The diffuser according to claim 3, wherein the hinge arrangement comprises projections adapted for restricting the doors to rotate so that the door plates extend parallel with the axis of symmetry of the diffuser shroud, and so that the door plates, at the open position of the doors diverge from each other downstream from the hinge axes.

9. The diffuser according to claim 1, wherein the diffuser shroud comprises one or more projections extending from the diffuser shroud and into the diffuser opening, and where the projections are positioned so that each of the doors, when they are positioned at their closed position, rests against one or more of the one or more projections at their downstream side.

10. An axial blower comprising a circular symmetrical blower pipe having an axis of symmetry, and a blower rotor arranged so that it rotates about the axis of symmetry of the blower pipe, and wherein the axial blower comprises a diffuser according to claim 1, and where the axis of symmetry of the diffuser virtually coincides with the axis of symmetry of the blower pipe.

* * * * *